United States Patent [19]

Ebbing

[11] 4,121,832

[45] Oct. 24, 1978

[54] GOLF PUTTER

[76] Inventor: Raymond A. Ebbing, 2615 E. Cinnabar St., Phoenix, Ariz. 85028

[21] Appl. No.: 773,907

[22] Filed: Mar. 3, 1977

[51] Int. Cl.[2] ..... A63B 53/06

[52] U.S. Cl. ..... 273/171; 273/173

[58] Field of Search ..... 273/77 R, 78, 80.1, 273/164, 167-175, 79

[56] References Cited

U.S. PATENT DOCUMENTS

| | | | |
|---|---|---|---|
| D. 238,285 | 12/1975 | Ross | 273/173 X |
| 684,532 | 10/1901 | Vehslage | 273/169 |
| 1,599,336 | 9/1926 | Lindgren | 273/168 X |
| 1,678,637 | 7/1928 | Drevitson | 273/173 X |
| 2,056,335 | 10/1936 | Wettlaufer | 273/173 X |
| 2,222,534 | 11/1940 | Harris | 273/168 X |
| 2,332,342 | 10/1943 | Reach | 273/171 |
| 2,781,197 | 2/1957 | Wiley | 273/169 X |
| 3,042,405 | 7/1962 | Solheim | 273/168 X |

FOREIGN PATENT DOCUMENTS

| | | | |
|---|---|---|---|
| 2,416 of | 1894 | United Kingdom | 273/173 |
| 5,741 of | 1891 | United Kingdom | 273/78 |

*Primary Examiner*—Richard J. Apley

*Attorney, Agent, or Firm*—Herbert E. Haynes, Jr.

[57] ABSTRACT

A golf club for putting comprising a variably configurable head which includes a carrier body having a demountably attached striker insert assembly. The striker insert assembly is formed with a cavity for containing removable weights and may be attached in various ways to the carrier body to change the loft and/or convert the club from right hand to left hand.

10 Claims, 4 Drawing Figures

GOLF PUTTER

BACKGROUND OF THE INVENTION

1. Field of the Invention

This invention relates to golf clubs and more particularly to a golf putter having a variably configurable head.

2. Description of the Prior Art

As is well known to golfing enthusiasts, golfing equipment manufacturers and others interested in the game, various putting styles, types of putters, practice equipment, and the like have been developed in attempts to master the skill. Among other considerations, such as the ability to read a green, development of the senses and timing required for aiming, gaging distances and stroking the ball, selection of a putter which feels right to the golfer is a very important factor. In attempting to obtain a putter having the right feel, a golfer may try several styles of putters before deciding which one feels right to him, and oftentimes will change putters when one he has been using, maybe for years, no longer feels right, or when he is attempting to correct problems which have developed in his putting.

In some instances, golfers have been known to change putters in accordance with the condition of the green, for example, on a wet green he will use a heavier putter than he would on a dry green.

To the best of my knowledge, all prior art putters employ a head which is cast or otherwise formed as a solid one-piece structure which leaves little or no possibility for a golfer to modify the head to suit himself. Thus, if a golfer wants to change his putter, for whatever reason, he must search through the tremendous number of commercially available putters until he finds one that suits, or most nearly suits, his requirements.

For the above reasons, golf equipment manufacturers provide a tremendous variety of putter styles, and many golfers own more than one. In addition to being expensive, from a manufacturing standpoint, and confusing as well as expensive from the user's standpoint, this condition creates problems for the retail supplier in that he must obtain and display a tremendous number of putters if he hopes to do a reasonable business in that area.

The magnitude of the above described problems will be easily understood upon consideration of the fact that many currently available putter styles must be fabricated and supplied in both right and left hand configurations.

Therefore, the need exists for a new and improved golf putter having a variably configurable head which overcomes some of the problems of the prior art.

SUMMARY OF THE INVENTION

In accordance with the present invention, a new and improved golf putter having a variably configurable head is disclosed as including a carrier body to which a striker insert assembly is demountably attached.

The striker insert assembly is provided with a cavity formed therein for containing removable weights so that the golfer can easily alter the weight of his putter to suit his personal preference or to suit the present playing conditions of the putting green.

The carrier body and the striker insert assembly are both especially configured so that the insert assembly can be mounted so as to face in either of the opposite directions relative to the carrier body, thus allowing the putter to be changed from a right hand to a left hand configuration. Also, the striker insert assemly can be inverted relative to the carrier body so that a given loft provided on the impact face of the striker insert assembly can be reversed.

Further, with the striker insert assembly being demountably attached to the carrier body, various designs of striker assemblies may be carried by the golfer and attached thereto to suit his preferences. For example, a striker insert assembly of a relatively standard configuration, may be easily replaced by the golfer with another configuration, such as that which is known as a mallet head, to achieve a different feel, and/or a striker insert assembly of a given loft may be replaced with one having a different loft.

Thus, the golf putter of the present invention will be seen to provide the golfer with a putter that he can modify to suit his personal preferences, and which substantially reduces the variety of putter styles and configurations that must be manufactured and displayed for purchaser consideration.

Accordingly, it is an object of the present invention to provide a new and improved golf club for putting.

Another object of the present invention is to provide a new and improved golf putter having a variably configurable head.

Another object of the present invention is to provide a new and improved golf putter having a variably configurable head to allow a golfer to modify the putter to suit his personal preferences or to suit the conditions of the putting green.

Another object of the present invention is to provide a new and improved putter having a variably configurable head which is easily disassembled to provide access to an internal cavity for the addition or removal of weights therefrom.

Another object of the present invention is to provide a new and improved golf putter having a variably configurable head which includes a carrier body and a demountably attached striker insert assembly.

Another object of the present invention is to provide a new and improved putter having a variably configurable head which includes a carrier body to which a striker insert assembly is demountably attached and may be assembled to the carrier body so as to provide either a right or left hand configuration.

Still another object of the present invention is to provide a new and improved putter having a variably configurable head which includes a carrier body to which a striker insert assembly may be demountably attached in either an upright or inverted position so as to reverse the loft of the impact face of the insert assembly.

Yet another object of the present invention is to provide a new and improved putter having a variably configured head which includes a standard carrier body that is adapted to receive any of a plurality of different styles of striker insert assemblies.

The foregoing and other objects of the present invention, as well as the invention itself, may be more fully understood from the following description when read in conjunction with the accompanying drawings.

DESCRIPTION OF THE PREFERRED EMBODIMENT

Figure 1:
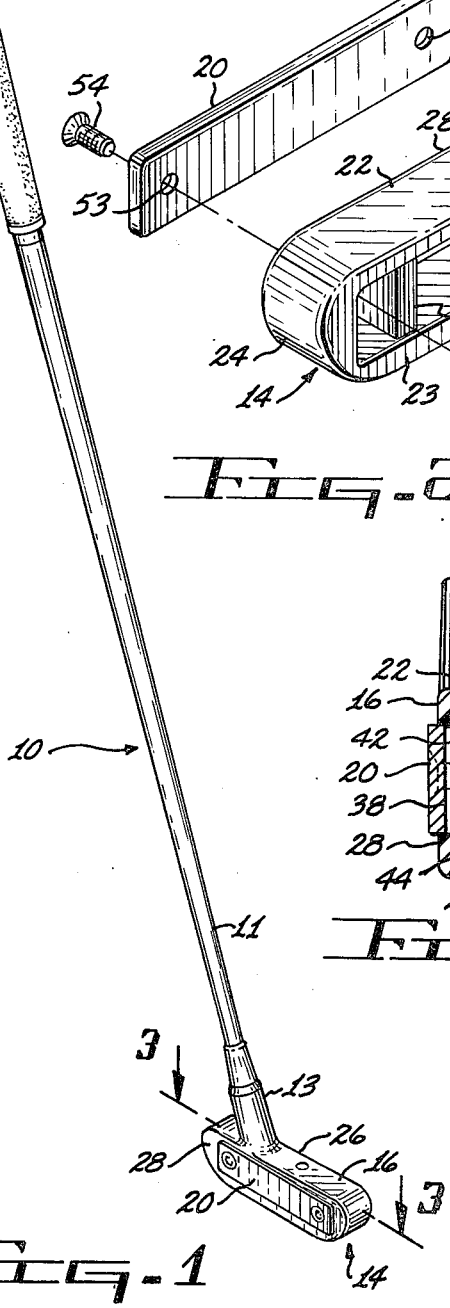
FIG. 1 is a perspective view of the golf club for putting of the present invention which illustrates the various features thereof.

Referring more particularly to the drawings, FIG. 1 illustrates the golf putter of the present invention which is indicated generally by the reference numeral 10. The putter 10 is seen to include the usual shaft 11 and grip 12 which are attached to the hosel 13 of the variably configurable head 14.

Figure 2:
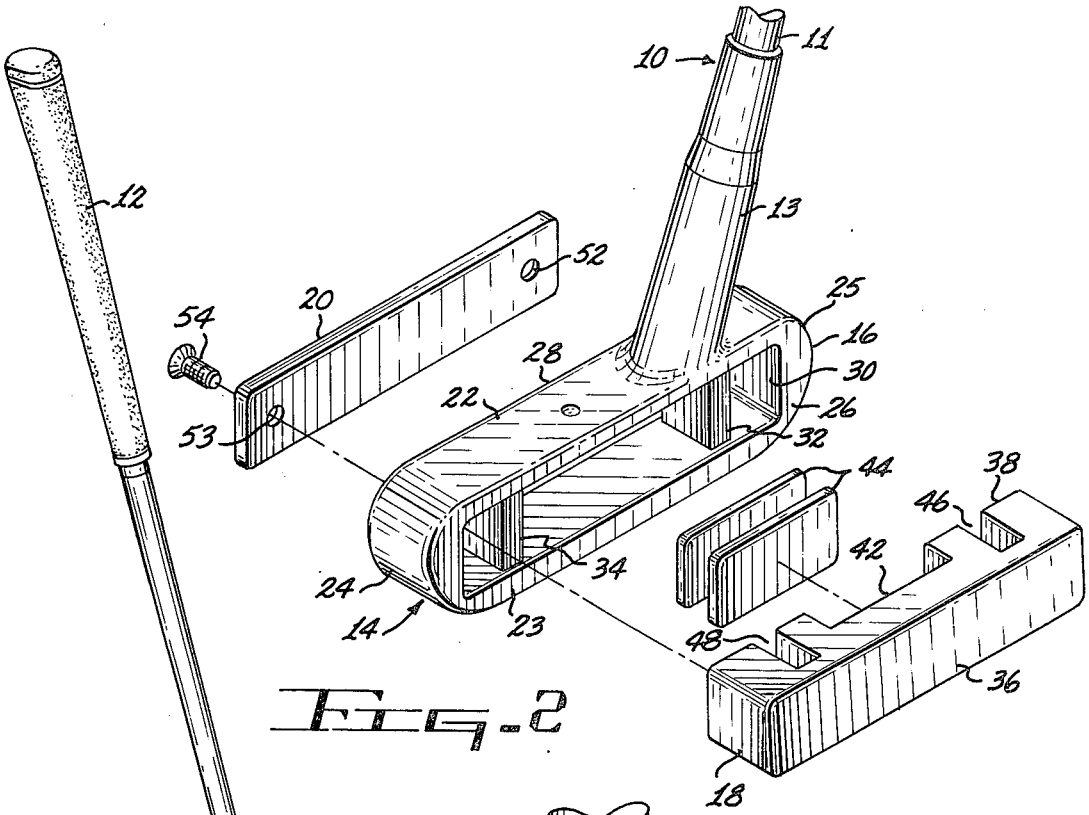
FIG. 2 is an enlarged isometric exploded view of the variably configurable head for the golf putter of the present invention.

As seen best in FIG. 2, the variably configurable head 14 includes a carrier body 16, a striker insert 18, and a retainer plate 20, with the striker insert 18 and the retainer plate 20 forming a striker insert assembly which is demountably attached to the carrier body 16 as will hereinafter be described in detail.

The carrier body 16 is formed with an upper wall 22, a lower or sole wall 23, a toe wall 24 and a heel wall 25 which define a first planar surface 26 and a spaced parallel second planar surface 28. A central opening or passage 30 of elongated generally rectangular configuration and of uniform cross section is formed through the body 16 so as to extend between and form identically configured openings in the first and second planar surfaces 26 and 28, with the walls 22, 23, 24, and 25 forming an endless perimeter around the opening. The central opening 30 formed in the carrier body 16 is provided with a spaced pair of uprights 32 and 34 formed therein so as to extend between the upper and sole walls 22 and 23, respectively, the uprights serving to structurally strengthen the carrier body 16 and, as will be described, act as stops for proper mounting of the striker insert assembly to the carrier body 16.

As is customary in the golf club art, the hosel 13 is integral with the carrier body 16 and extends angularly, rearwardly and upwardly from the upper wall 22 of the carrier body at a suitable angle and is adapted for affixation of the shaft 11 thereto in accordance with techniques well known in the art.

The carrier body 16 and integral hosel 13 may be fabricated of any suitable material and in accordance with well known techniques. However, it is preferred that synthetic materials of the type which have become known as plastics be used due to the ease of fabrication, light weight, and other desirable characteristics of specific forms of such material. A particular material which has been found to be ideally suited for this purpose is marketed under the trademark, Lexan by the General Electric Co. As is known, Lexan is a light weight extremely tough material having good dimensional stability and which lends itself well to the injection molding technique employed in fabrication of the carrier body 16 and hosel 13.

The striker insert 18 is formed of suitable metal such as brass, stainless steel, and the like, and may be fabricated by machining standard stock to the proper configuration or by any other commonly employed technique such as casting. The striker insert 18 is of generally rectangular configuration, which is sized as to length and width to fit within the central opening 30 formed in the carrier body 16, as will hereinafter be described in detail, and has an elongated impact face 36 formed on one side thereof with an opposite surface 38.

Figure 4:
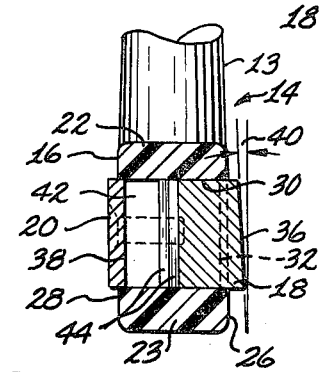
FIG. 4 is a sectional view taken on the line 4—4 of FIG. 3.

The impact face 36 of the striker insert 18 may be formed with a loft 40 thereon which as best seen in FIG. 4, is the angular deviation from vertical orientation of the impact face 36. Generally speaking, most golf clubs are provided with a loft and the normal loft of a putter is approximately 2°. However, it will be understood that the striker insert 18 can be fabricated with any desired loft and in fact, can be formed with no loft.

The opposite surface 38 of the striker insert 18 is formed with a central cavity 42 therein for receiving removable weights 44, as will hereinafter be described, and is provided with a pair of slots 46 and 48 which are each located adjacent a different side of the central cavity 42. Further, a pair of threaded bores 49 and 50 are each formed adjacent a different one of the opposite ends of the striker insert 18. The central cavity 42, the slots 46 and 48, and the threaded bores 49 and 50, are formed so as to extend inwardly into the striker insert 18 from the opposite surface 38 toward the impact face 36, and the cavity 32 and slots 46 and 48 are open at their opposite ends. The slots 46 and 48 are positioned in the striker insert 18 so as to align with and receive the spaced pair of uprights 32 and 34 provided in the central opening 30 of the carrier body 16 when the striker insert 18 is installed therein.

As hereinbefore mentioned, the retainer plate 20 also forms part of the striker insert assembly and is shown as a generally rectangular flat plate which is sized to fit into the central opening 30 formed in the carrier body 16, and thus, is substantially equal in length and width dimensions to the impact striker 18. The retainer plate 20 is provided with a pair of apertures 52 and 53 each formed adjacent a different one of the opposite side edges of the plate, with those apertures positioned so as to align with the threaded bores 49 and 50 of the striker insert 18 when the plate 20 and insert 18 are installed in the opening 30 of the carrier body 16.

Figure 3:
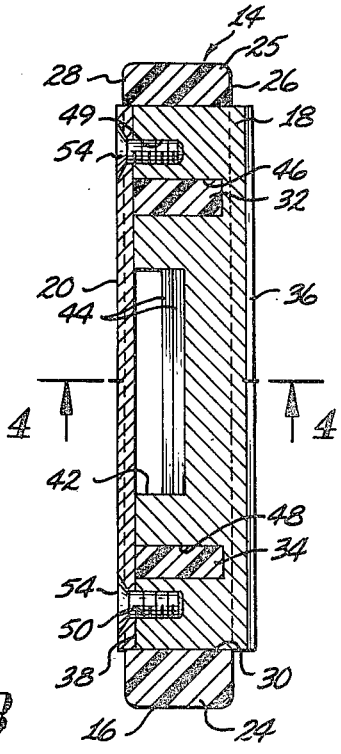
FIG. 3 is an enlarged sectional view taken on the line 3—3 of FIG. 1.

As seen best in FIGS. 3 and 4, the striker insert assembly is demountably attached to the carrier body 16 by inserting the striker insert 18 into the central opening 30 so that the uprights 32 and 34 enter into the slots 46 and 48 and move into engagement with the bottom surfaces of those slots. The retainer plate 20 is then inserted into the central opening 30 from a direction which is opposite to the direction from which the striker insert 18 was installed. When the retainer plate 20 is thus installed, one of its planar surfaces will be in engagement with the surface 38 of the striker insert 18 and with the uprights 32 and 34, and the apertures 52 and 53 of the plate 20 will be in alignment with the threaded bores 49 and 50 of the striker insert 18. Suitable screws 54, such as the flat head Allen screw shown, are employed to affix the plate 20 to the insert 18 which clamps the insert in straddling engagement with the uprights 32 and 34 provided in the opening 30 of the carrier body 16.

It will be noted that the above described demountable affixing of the striker insert assembly is shown as having been accomplished so that the impact face 36 of the insert 18 is adjacent the first planar surface 26 of the carrier body 16, with that orientation providing a right hand configuration of the golf putter 10. By simply reversing the directions that the insert 18 and the plate 20 are installed into the opening 30, the impact face 36 will be located adjacent the second planar surface 38 of the carrier body 16 which results in a left hand configuration of the putter 10.

Another feature of the putter 10 is that if a golfer wishes, he can reverse the loft 40 of the putter by installing the striker insert 18 in inverted orientation relative to that shown with the results, of course, being that the golf ball (not shown) when struck by the putter of such configuration will have different ball rolling characteristics.

As hereinbefore mentioned, the central cavity 42 provided in the striker insert 18 is adapted to contain removable weights 44. This feature is provided so that a golfer can experiment with different swing weights until he arrives at a particular weight which feels right. This same feature also allows the golfer to change the swing weight of this putter to suit conditions of particular putting surfaces. For example, a predetermined amount of weight can be added when the putting greens are wet and the added weight can be removed when the greens are dry. Although any desirable form of weights can be used, sheets or slabs of lead having a suitable adhesive backing (not shown) are preferred in that the adhesive will prevent the occurance of weight shifting and any distracting noise which could occur with loose weights. An alternative to adhesive backed lead weights would be to employ a suitable packing material (not shown), such as foam rubber, to prevent loose weights from moving in the cavity 42.

Although the retainer plate 20 is shown as being flat, that plate could easily be replaced by other configurations of plates (not shown) to alter the appearance and swing characteristics of the golf putter 10. For example, the putter 10 could be easily converted into the type of putter sometimes referred to as a mallet head by simply replacing the retainer plate 20 with a plate (not shown) having a protruding bulge formed thereon.

The golf putter 10 of the present invention as described above is provided with inherent features which aid a golfer in mastering the skill of putting. The first of these inherent features is derived from the striker insert 18 and the retainer plate 20 protruding oppositely from the opening 30 beyond the first and second planar surfaces 26 and 28 of the carrier body 16. Such protruding visually presents a pair of spaced parallel lines to the golfer and those lines which extend longitudinally of the carrier body 16 are normal to the path that a properly struck golf ball will follow, and thus, will visually assist the golfer in lining up for a putt. The second inherent feature of the putter of the present invention relates to aiding the golfer in keeping the putter in as flat a plane as possible during a putter stroke. As is well known, one of the desirable skills needed in putting is to swing the putter in a flat plane which is parallel to the ground or in the absence of such a flat swing, the golfer should make sure that the bottom of an arcuate or pendulous swing is reached simultaneously with making contact with the ball. If a flat swing or a properly timed arcuate swing is not achieved, hopping and other undesirable ball roll characteristics can result. The putter 10 helps in this regard due to the protruding impact surface 36 of the insert 18 and due to the insert being located above the sole wall 23 of the carrier body 16. In the event that the putter is improperly swung so that contact with the ball is made by the leading or bottom edge of the impact face 36, or is simultaneously made by that leading edge and the sole wall 23, the golfer will immediately know what has occurred by the feel of such impact.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A golf club for putting comprising:

a. an elongated carrier body with an integral hosel and having parallel opposite first and second side surfaces extending longitudinally thereof, said carrier body having a passage formed therethrough so as to extend between the first and second side surfaces thereof with the passage of uniform cross section to form an identically configured opening in each of the first and second side surfaces;

b. a shaft affixed on one of its ends to the hosel of said carrier body and extending therefrom;

c. an insert assembly having an impact face formed thereon said insert assembly demountably affixed in the passage of said carrier body with the impact face thereof protruding from the passage of said carrier body; and d. said insert assembly having an exterior configuration which substantially matches the interior configuration of the passage of said carrier body so that said insert assembly is reversibly and invertibly positionable in the passage of said carrier body to allow optional orientation of the impact face relative to said carrier body.

2. A golf club for putting as claimed in claim 1 wherein said insert assembly is demountably affixed in the passage of said carrier body so that the impact face is positioned adjacent the first side surface of said carrier body.

3. A golf club for putting as claimed in claim 1 wherein said insert assembly is demountably affixed in the passage of said carrier body so that the impact face is positioned adjacent the second side surface of said carrier body.

4. A golf club for putting as claimed in claim 1 wherein the impact face of said insert assembly is angularly disposed and said insert assembly is demountably affixed in the passage of said carrier body so that the impact face slopes angularly upwardly from the bottom of said insert assembly toward said carrier body.

5. A golf club for putting as claimed in claim 1 wherein the impact face of said insert assembly is angularly disposed and said insert assembly is demountably affixed in the passage of said carrier body so that the impact face slopes angularly downwardly from the top of said insert assembly toward said carrier body.

6. A golf club for putting comprising:

a. an elongated carrier body having an integral hosel and an opposed pair of parallel side surfaces extending longitudinally thereof, said carrier body having a rectangular passage extending therethrough between the opposed side surfaces and forming identical openings in each of the opposed side surfaces of said carrier body;

b. a shaft affixed to the hosel of said carrier body and extending therefrom;

c. a striker insert of rectangular configuration optionally positioned within either one of the identical openings formed in the opposed side surfaces of said carrier body;

d. a retainer plate of rectangular configuration positioned within the other one of the identical openings formed in the side surfaces of said carrier body;

e. at least one vertically disposed upright formed in the rectangular passage of said carrier body and integral therewith, said upright recessed from the identical openings formed in the opposed side surfaces of said carrier body and interposed between said striker insert and said retainer plate; and f. means for demountably interconnecting said striker insert and said retainer plate to hold them in bearing engagement with said interposed upright.

7. A golf club as claimed in claim 6 wherein said striker insert is formed with an impact face extending longitudinally thereof and an opposite surface in which a cavity is formed.

8. A golf club as claimed in claim 7 and further comprising at least one weight demountably positioned in the cavity formed in said striker insert.

9. A golf club as claimed in claim 6 wherein said striker insert is formed with an impact face extending longitudinally thereof and an opposite surface, the impact face sloping angularly toward the opposite surface to provide said golf club with a loft.

10. A golf club as claimed in claim 9 wherein said striker insert is invertibly positionable in said carrier body to allow inverting of the loft provided by the impact face of said striker insert.

* * * * *